US005562485A

United States Patent [19]

Hoyte et al.

[11] Patent Number: 5,562,485

[45] Date of Patent: Oct. 8, 1996

[54] WIRING CONNECTION

[75] Inventors: David S. Hoyte, Dublin, Ohio; Rick E. Galphin, Springfield, Tenn.

[73] Assignee: White Consolidated Industries, Inc., Cleveland, Ohio

[21] Appl. No.: 302,111

[22] Filed: Sep. 6, 1994

[51] Int. Cl.[6] ..... H01R 13/62

[52] U.S. Cl. ..... 439/489; 439/346

[58] Field of Search ..... 439/488, 489, 439/345, 346, 347, 725, 855, 857

[56] References Cited

U.S. PATENT DOCUMENTS

| | | | |
|---|---|---|---|
| 176,069 | 4/1876 | Ryder | 439/848 |
| 2,579,739 | 6/1948 | Hayes | 439/849 |
| 2,704,831 | 3/1955 | Smith | 439/346 |
| 4,136,919 | 1/1979 | Howard et al. | 439/346 |
| 4,220,388 | 9/1980 | Dechelette | 439/268 |
| 4,319,797 | 3/1982 | Otani et al. | 439/346 |
| 4,490,003 | 12/1984 | Robinson | 439/347 |
| 4,558,913 | 12/1985 | Goto et al. | 439/268 |
| 4,566,747 | 1/1986 | Peers | 439/849 |
| 4,720,273 | 1/1988 | Thole | 439/592 |
| 4,781,611 | 11/1988 | Leonard | 439/259 |
| 5,038,199 | 8/1991 | Igarashi | 359/81 |
| 5,427,543 | 6/1995 | Dynia | 439/346 |

*Primary Examiner*—Hien D. Vu

*Attorney, Agent, or Firm*—Pearne, Gordon, McCoy & Granger

[57] ABSTRACT

An electrical connector including a female receptacle and a male spade which cooperate to provide an assembler with sensory indication that electrical connection has been established. The male spade has a body portion which provides a pair of opposed notched recesses. The female receptacle has a metal insert which is integrally molded into a plastic housing and receives the male spade. The plastic housing has a pair of opposed side walls which each provide a deformable arm. The arms have a lower end which includes an inwardly projecting portion that snaps into the notched recess in the spade when the spade is fully inserted into the receptacle. As the spade is inserted into the insert, the inwardly projecting portions slidably engage the spade and cause the arms to be outwardly deflected relative to the housing side wall, thereby providing the assembler with visual and tactile indication that the spade and receptacle are not properly connected. Further insertion of the spade into the insert causes the inwardly projecting portions to snap into the recesses, resulting in outer surfaces of the arms being generally in-line with the housing side walls which indicates, upon visual or tactile inspection, that the spade and receptacle are properly connected.

18 Claims, 2 Drawing Sheets

WIRING CONNECTION

BACKGROUND OF THE INVENTION

The present invention relates to electrical connectors and, more particularly, electrical connectors which provide an assembler with sensory indication that a good connection has been made and which help prevent unintentional disconnection.

U.S. Pat. No. 176,069 is exemplary of an early type of connector which was designed to provide the user with indication that a good connection has been made, and to prevent inadvertent disconnection. The '069 connector includes a female receptacle and a male plug. The receptacle has a pair of outwardly extending arms which are received within an annular groove provided on the exterior of the male plug. A set screw secures a conductor, which projects from the male plug, to the receptacle. U.S. Pat. No. 4,781,611 discloses another type of connector having a pair of deformable arms to releasably secure a female receptacle to a male spade.

U.S. Pat. No. 2,579,739 discloses a connector having a male spade and a female receptacle. The male spade provides a pair of notched recesses, and the female receptacle has a body with a pair of deformable wings which are bent back over the body to form a pair of resilient jaws. When the spade is inserted between the body portion and the jaws, a rounded tip provided by each of the jaws extends into one of the notched recesses and connects the spade to the receptacle. Related spade to receptacle connectors are shown in U.S. Pat. Nos. 4,220,388; 4,556,747; 4,558,913; 4,720,273; and 5,038,199.

SUMMARY OF THE INVENTION

The present invention provides a connector including male spade and a female receptacle which allows an installer to visually determine whether a good connection between the spade and receptacle has been established and which helps prevent unintentional disconnection of the spade from the receptacle.

In accordance with the present invention, the spade is formed of metal and has an elongated body in which a notched recess is formed. The female receptacle includes a metal insert and a plastic housing.

In further accordance with the present invention, the insert is surrounded by the housing and slidably receives the spade. The housing has a resiliently deformable arm that includes an inwardly projecting portion which is received within the notched recess when the spade is fully inserted into the metal insert. When the spade is fully inserted into the insert, the arm is generally in-line with the housing side wall to visually indicate that the spade and receptacle are properly connected. Receipt of the arm in the notched recess helps to prevent unintentional disconnection of the spade from the receptacle.

In further accordance with the present invention, when the spade is not fully inserted into the metal insert the arm is outwardly displaced from a side wall of the housing to visually indicate to the assembler that the spade and receptacle are not properly connected.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 2:
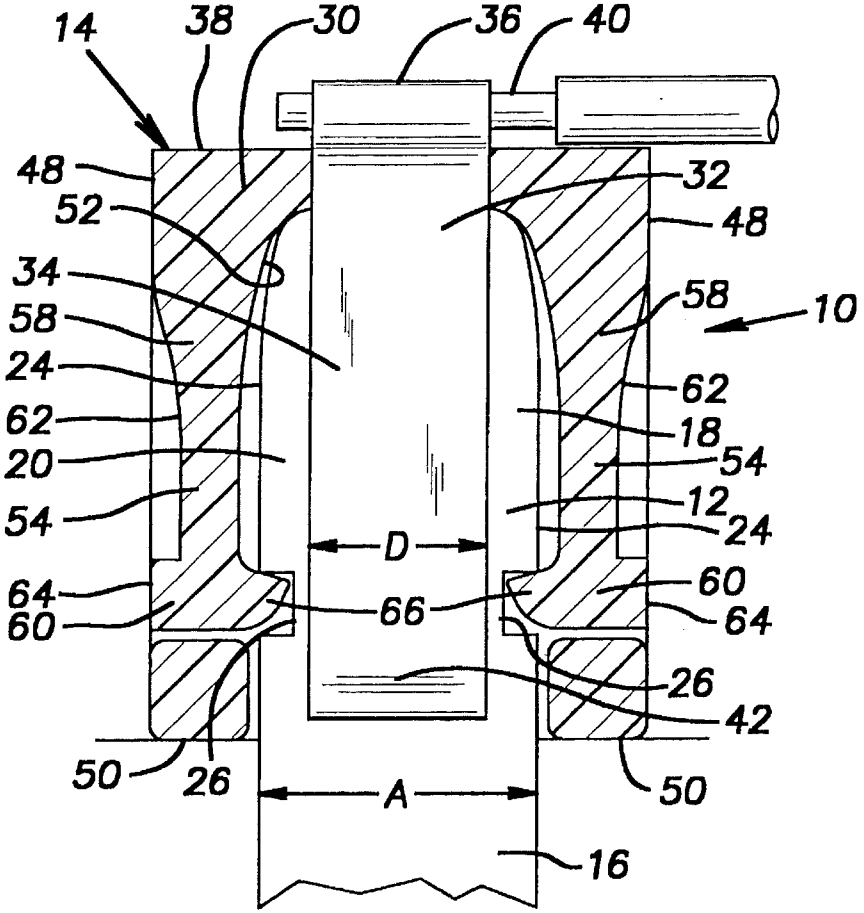
FIG. 2 is a front view, in cross section, of the electrical connector according to the present invention showing the spade inserted in the receptacle, as illustrated in FIG. 1.

With reference to the drawing figures, the electrical connector 10 according to the present invention includes a male spade 12 and a female receptacle 14.

Figure 1:
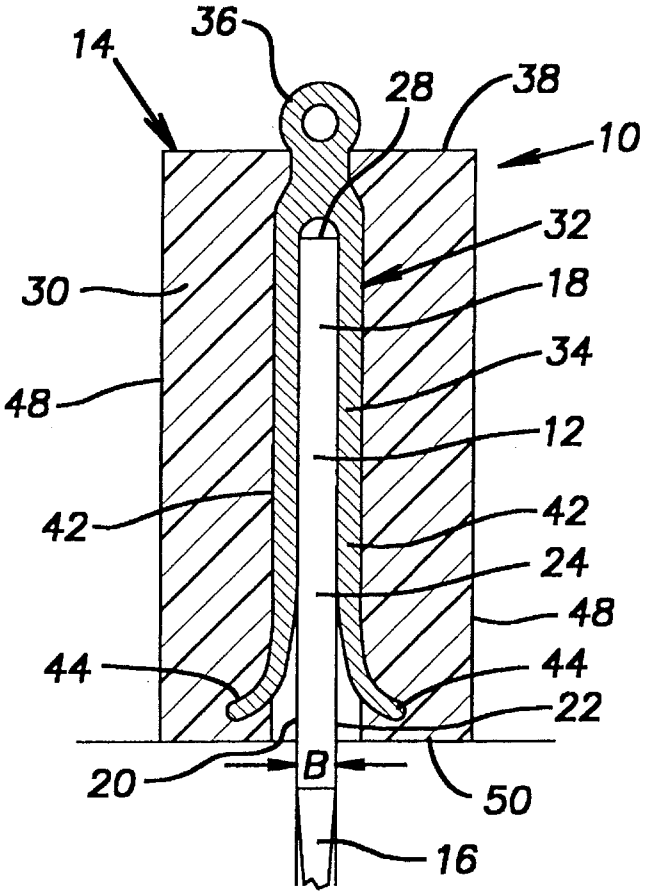
FIG. 1 is a side view, in cross section, of an electrical connector according to the present invention showing a male spade inserted in and connected to a female receptacle.

The male spade 12 has a base portion 16 which is, preferably, mounted to a stationary piece of electrical equipment (not shown), such as an electric motor, and an elongated body 18 which projects upwardly from the base portion 16. The elongated body 18 has a front surface 20, a rear surface 22, and a pair of lateral or side surfaces 24. The front and rear surfaces 20, 22 have a width dimension A (FIG. 2), and the lateral or side surfaces 24 have a width dimension B (FIG. 1).

Figure 3:
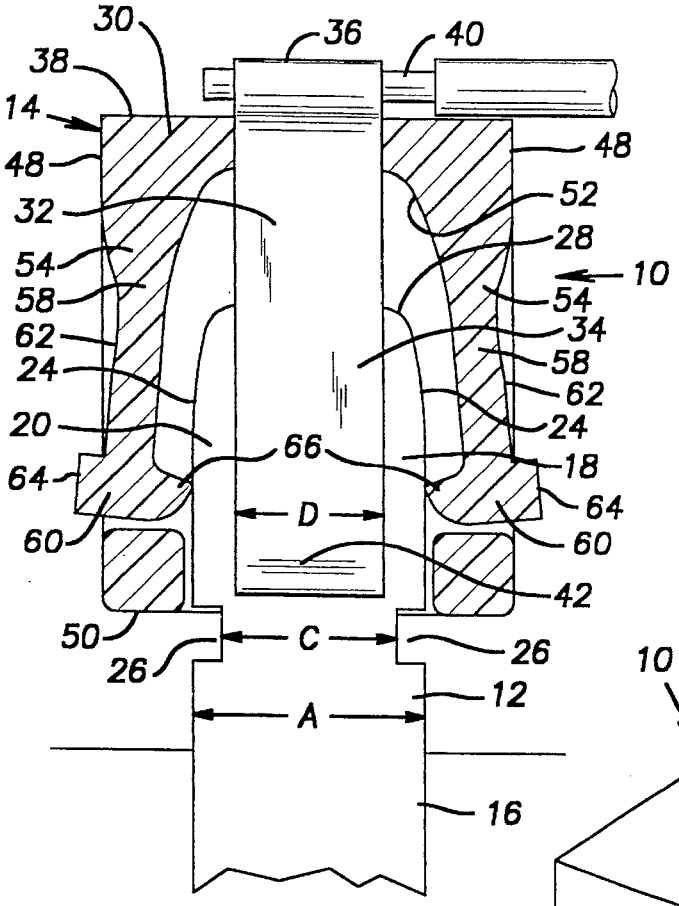
FIG. 3 is a front view, in cross section, of the electrical connector according to the present invention during insertion of the spade into the receptacle; and, FIG. 4 is a perspective view showing the electrical connector during insertion of the spade into the receptacle, as illustrated in FIG. 3.

Each of the side surfaces 24 have a notched recess 26 formed therein which projects into the front and rear surfaces 20, 22 of the elongated body 18 and are adapted to receive a portion of the female receptacle 14, as will be described more fully hereinafter. The notched recesses 26 are spaced apart a distance C (FIG. 3). A top or terminal surface 28 of the elongated body 18 is rounded over to facilitate insertion of the male spade 12 into the female receptacle 14.

The female receptacle 14 includes a molded plastic housing 30 and a metal insert 32. The metal insert 32 has a generally U-shaped body portion 34 (FIG. 1) from which projects a connector portion 36. The connector portion 36 extends through a top wall 38 of the plastic housing 30 and receives an electrical conductor 40. The U-shaped body portion 34 includes a pair of opposed arms 42, each of which have a lower end 44 which is curved outwardly and embedded in the plastic housing 30 during the molding process, as shown best in FIG. 1.

The arms 44 have a width dimension D, which, preferably, is slightly less than the distance C between the pair of notched recesses 26 in the male spade 12. The arms 44 are spaced apart a distance which, preferably, is slightly less than the width dimension B of the lateral or side surfaces 24 of the male spade 12, as shown best in FIG. 1.

In addition to the top wall 38, the plastic housing 30 has a front wall 46, a rear wall (not shown), a pair of side walls 48, and a bottom wall 50 which cooperate to provide an inner surface 52 for the plastic housing 30. The inner surface 52 is generally cup-shaped and defines a hollow interior which is accessible through an opening in the bottom wall 50 of the housing 30.

Figure 4:
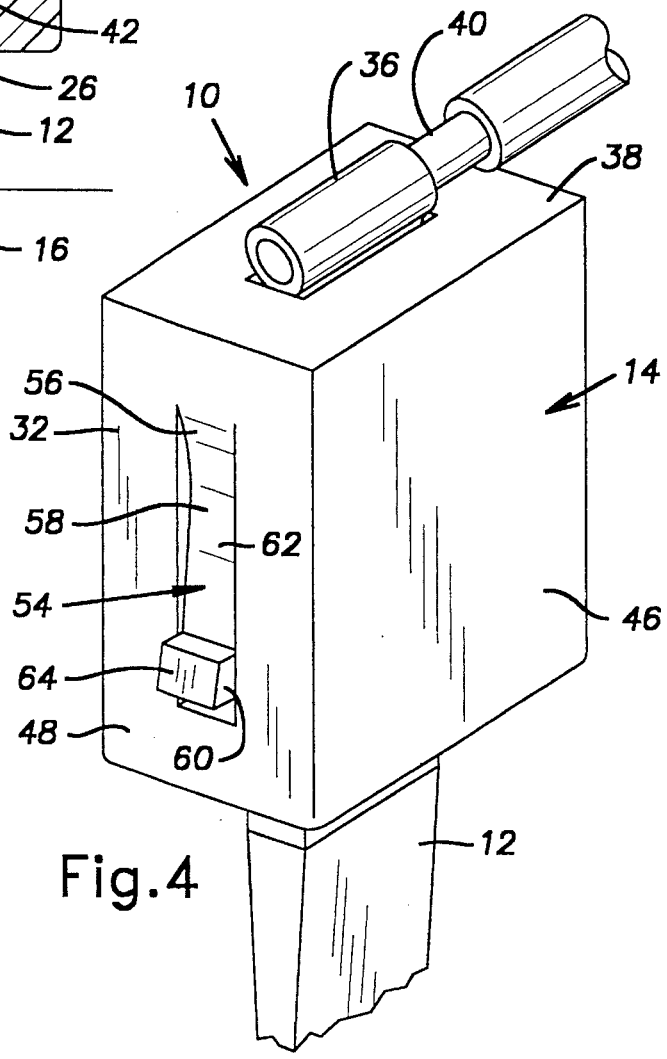

Each of the side walls 48 include a resiliently deformable arm 54 which is connected to the associated side wall 48 at a top end 56 thereof. The arms 54 are separate from and movable relative to the housing side walls 48 at their bottom end and lateral sides (FIG. 4).

The arms 54 have upper and lower portions 58, 60, the upper portion 58 having a curved outer surface 62 which is recessed relative to the housing side walls 48 while the lower portion 60 has a planar outer surface 64 which is generally in-line or coplanar with the housing side walls 48 when the receptacle 14 is at rest or properly connected to the spade 12 (FIG. 2). The lower portion 60 of each arm also provides an inwardly projecting portion or hook 66 which is received by one of the respective notched recesses 26 in the lateral or side surface 24 of the male spade 12.

During assembly or connection of the male spade 12 to the female receptacle 14, the male spade 12 is inserted through the opening in the bottom wall 50 of the housing 30 and between the arms 42 of the metal insert 32. As the spade 12 is pushed into the metal insert 32, the inwardly projecting portions 60 of the resiliently deformable arms 54 engage the lateral or side surfaces 24 of the spade 12 and cause the arms 54 to deform outwardly, as shown in FIGS. 3 and 4. The outer surfaces 64 of the lower portions 60 of the arms 54 are displaced from the side walls 48 of the plastic housing 30 and serve as visual indication to the assembler that the spade 12 and receptacle 14 are not properly connected. Moreover, displacement of the lower portions 60 of the arms 54 from the side walls 48 of the housing 30 serves as a tactile indicator that the spade 12 and receptacle 14 are not properly connected, which is helpful to the assembler and necessary if the assembler is visually impaired or cannot directly see the housing side walls 48.

Further insertion of the spade 12 into the insert 32 causes the inwardly projecting portions 66 to snap into the notched recesses 26 in the male spade 12, as shown best in FIG. 2. The spade 12 thus engages and is electrically connected to the metal insert 32. The top surface 28 of the male spade engages or abuts the inner surface 52 of the housing 30 to limit insertion of the male spade 12 into the receptacle 14.

When the inwardly projecting portions 66 are received by the notched recesses 26, the outer surfaces 64 of the arms' lower portions 60 are generally in line or coplanar with the housing side walls 48, which serves as both visual and tactile indication that the spade 12 and receptacle 14 are properly connected.

While the preferred embodiment of the present invention is shown and described herein, it is to be understood that the same is not so limited but shall cover and include any and all modifications thereof which fall within the purview of the invention. For example, the deformable arms 54 could have a lower end attached to the housing side walls and have an upper end and lateral sides movable relative to the housing side walls. Moreover, the notched recesses 26 could be at different locations along the length of the male spade 12, and the inwardly directed portions at corresponding locations in the plastic housing 30, to allow the receptacle 14 and spade 12 to be positively oriented in a predetermined direction when connected together. Further, the female receptacle could be mounted to a piece of electrical equipment, such as an electric motor, and the male spade movable relative thereto. Therefore, it is apparent that the scope of the present invention is not limited to the preferred embodiment illustrated herein, but rather is only defined by the claims appended hereto.

What is claimed is:

1. An electrical connector, comprising:

a male spade formed of metal and having an elongated body in which a notched recess is formed; and, a female receptacle having a metal insert and a plastic housing, said insert being molded into and surrounded by said housing and slidably receiving said spade, aid housing having a side wall, said side wall including a resiliently deformable arm, said arm having a first end integrally formed with said side wall at a first location and a second end separated from and movable relative to said side wall at a second location, said second end being opposite said first end and including an inwardly projecting portion which is received within the notched recess when the spade is fully inserted into the metal insert to securely fasten the spade to the receptacle, wherein, during insertion of said spade into said insert, said inwardly projecting portion engages said spade and causes the second end of the arm to be outwardly displaced from the side wall of said housing to provide visual indication to an assembler that said spade must be further inserted into said metal insert to properly connect said spade to said receptacle.

2. A connector according to claim 1, wherein the metal insert has a generally U-shaped body portion which receives said spade.

3. A connector according to claim 1, wherein said male spade provides a pair of notched recesses and said plastic housing provides a pair of resiliently deformable arms.

4. A connector according to claim 3, wherein said notched recesses are opposite one another and said arms are opposite one another.

5. A connector according to claim 1, wherein an outer surface of said resilient arm is generally in-line with the housing side wall when the spade is fully inserted into the metal insert.

6. A connector according to claim 1, wherein the resilient arm has lateral sides which are separated from and movable relative to said housing side wall.

7. A connector according to claim 1, wherein the first and second ends each have inner and outer surfaces, the outer surface of the first end being recessed relative to the outer surface of the second end, said second end outer surface being generally coplanar with said housing side wall when the male spade is fully inserted into the metal insert.

8. A connector according to claim 1, wherein the male spade abuts an interior surface of the plastic housing when fully inserted into the metal insert.

9. A connector according to claim 1, wherein the projecting portion of the resilient arm is the only point of contact between the resilient arm and the male spade.

10. An electrical connector, comprising:

a male spade formed of metal and having a base portion and an elongated body, said body having front, rear, and a pair of side surfaces, said front and rear surfaces having a width dimension greater than a width dimension of said side surfaces, each of said side surfaces having a notched recess formed therein which extends into the front and rear surfaces; and, a female receptacle comprising a metal insert and a plastic housing, said metal insert having a generally U-shaped body portion received within said housing and a connector portion projecting from said body portion and extending outwardly from said housing, said connector portion receiving an electrical conductor, said body portion including a pair of arms, each of said arms having a width dimension which is less than the width dimension of said front and rear surfaces of said male spade and said arms are spaced apart a distance slightly less than the width dimension of said side surfaces of said male spade, wherein said housing has an open bottom through which said male spade is inserted between said arms and includes front, rear, and a pair of side walls, each of said housing side walls including a resilient arm, said resilient arms having a first end which is integrally formed with the housing at a first location, and a second end which is separated from and movable relative to the housing at a second location, said second end being opposite said first end and including an inwardly projecting portion which is received within one of the notched recesses when the spade is fully inserted into the metal insert to securely fasten said receptacle to said spade.

11. A connector according to claim 10, wherein the metal insert is integrally molded into the plastic housing and said connector portion has a lower end which is outwardly directed and embedded in said plastic housing.

12. A connector according to claim 10, wherein said notched recesses are opposite one another and are provided in the elongated body of the male spade at a location relatively closer to said base portion than to an opposite end of said male spade.

13. A connector according to claim 10, wherein said resilient arms are resiliently displaced outwardly from said side walls of said housing during insertion of the male spade into the metal insert and, when the spade is fully inserted into the insert, are generally in-line with the housing side walls.

14. A connector according to claim 10, wherein the resilient arms have lateral sides which are spaced from and movable relative to the housing side walls.

15. A connector according to claim 10, wherein the first and second ends each have inner and outer surfaces, the outer surface of the first end being recessed relative to the outer surface of the second end, said second end outer surface being generally coplanar with said respective side wall when the male spade is fully inserted into the metal insert.

16. A connector according to claim 10, wherein the male spade abuts an inner surface of the plastic housing when fully inserted into the metal insert.

17. A connector according to claim 10, wherein the projecting portion of the resilient arms is the only point of contact between the resilient arms and the male spade.

18. A method of assuring electrical connection between a metal male spade and a female receptacle, said male spade having an elongated body with front, rear, and a pair of side surfaces, said female receptacle comprising a metal insert and a plastic housing, said metal insert having a U-shaped body receiving the elongated body of said male spade, said housing having opposed side walls, comprising the steps of:

providing each of said metal male spade side surfaces with a notched recess;

providing each of said side walls of said housing with a resilient arm, said resilient arms having a first end integrally formed with said housing at a first location and a second end separated from and movable relative to the housing at a second location, said second end being opposite said first end, an outer surface of said second end being generally co-planar with a respective side wall prior to insertion of said spade into said metal insert;

inserting said metal male spade into be U-shaped body of said metal insert, said spade side surfaces slidably engaging an inwardly projecting portion provided by each of said second ends of said resilient arms to outwardly displace said second end outer surfaces from said housing side walls, displacement of said second end outer surfaces serving as visual indication to an assembler that said spade and receptacle are not properly connected to one another; and further inserting said spade into said insert until said inwardly projecting portions snap into said notched recesses, said second end outer surfaces being generally co-planar with respective side walls and thereby provide the assembler with visual indication that the spade and receptacle are properly connected.

* * * * *

UNITED STATES PATENT AND TRADEMARK OFFICE

CERTIFICATE OF CORRECTION

PATENT NO. : 5,562,485

DATED : October 8, 1996

INVENTOR(S) : Hoyte et al.

It is certified that error appears in the above-indentified patent and that said Letters Patent is hereby corrected as shown below:

Column 1, line 31, delete "4,556,747;" and insert --4,566,747;--.

Column 4, line 1 (Claim 1, line 6), delete "aid" and insert --said--.

Signed and Sealed this

Twenty-fourth Day of December, 1996

*Attest:*

Bruce Lehman

BRUCE LEHMAN

*Attesting Officer*

*Commissioner of Patents and Trademarks*